US006802087B1

(12) United States Patent
Podue et al.

(10) Patent No.: US 6,802,087 B1
(45) Date of Patent: Oct. 12, 2004

(54) STRUCTURE LIFT

(75) Inventors: David R. Podue, Oceanside, CA (US); Angelo Vito Pugliese, Jr., Vista, CA (US)

(73) Assignee: Dimension One Spas, Vista, CA (US)

( * ) Notice: Subject to any disclaimer, the term of this patent is extended or adjusted under 35 U.S.C. 154(b) by 0 days.

(21) Appl. No.: 10/403,619

(22) Filed: Mar. 28, 2003

(51) Int. Cl.[7] ..... A47K 3/00; E04H 4/00
(52) U.S. Cl. ..... 4/541.1; 4/506
(58) Field of Search ..... 4/506, 541.1

(56) References Cited

U.S. PATENT DOCUMENTS 3,648,300 A * 3/1972 Eisenberg ..... 4/494
3,815,162 A * 6/1974 Hall ..... 52/169.7

* cited by examiner

*Primary Examiner*—Charles E. Phillips
(74) *Attorney, Agent, or Firm*—Fish & Richardson P.C.

(57) ABSTRACT

Systems and techniques to facilitate lifting and access to compartments, such as spa compartments that contain spa features. A structure includes a base, risers rotatably coupled with an underside of the base, a support frame rotatably coupled with the risers, rollers rotatably coupled with the support frame, and one or more lever-arms rotatably coupled with at least one of the risers, the one or more lever-arms supporting the base when the support frame is in a nested position, and the one or more lever-arms providing leverage during transition from the nested position to an actuated position of the support frame, said transition causing the base to lower and be movable on the rollers.

6 Claims, 9 Drawing Sheets

STRUCTURE LIFT

TECHNICAL FIELD

The present disclosure describes systems and techniques relating to lifting devices, for example, a spa structure lift used to facilitate spa operation and maintenance.

BACKGROUND

In recent years, spa technology has advanced and spa related accessories have increased in number. As a result, a typical spa can include numerous accessories, which may be complicated products in themselves, irrespective of their being included with a spa. Such accessories may include aftermarket options that spa owners purchase to further enjoy their spa. Additionally, spas have become more decorative and are often considered part of the landscaping of a home. As a result, leaving accessories and spa-related equipment outside of the spa decreases the attractiveness of the spa and degrades the landscaping of the home.

SUMMARY

The present disclosure includes systems and techniques relating to lifting devices that may facilitate access to compartments, such as spa compartments that contain spa features. According to an aspect, a structure includes a base, risers rotatably coupled with an underside of the base, a support frame rotatably coupled with the risers, rollers rotatably coupled with the support frame, and one or more lever-arms rotatably coupled with at least one of the risers, the one or more lever-arms supporting the base when the support frame is in a nested position, and the one or more lever-arms providing leverage during transition from the nested position to an actuated position of the support frame, said transition causing the base to lower and be movable on the rollers.

One or more of the following advantages may be provided. The systems and techniques described may result in simplified access to compartments through an access panel, such as the auxiliary module described herein. A single technician or service person may be enabled to remove, reposition and manipulate a heavy access panel with ease and without risking injury to personnel or to equipment, such as electronic equipment contained within the access panel. Spa operation, maintenance and/or use may be facilitated. The lift may be integrated into the access panel such that it is easy to store in a nested position, blending in with the underside of the spa to preserve the decorative nature of the spa, and also serve as an added support for the access panel when in the nested position. Moreover, the lift may be a simple, cost effective package that requires minimal maintenance.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

The systems and techniques described here relate to lifting devices, such as may be used in connection with a spa. As used herein, the term "spa" means a tub used for relaxation, invigoration or health, and includes a device for moving water in the tub; the term "spa" includes free-standing spas, swim spas, and spas generally, regardless of size. The present inventors recognized that an access panel may contain components, which can be damaged when manipulating the access panel, and the access panel may be too heavy for a single technician to manipulate easily. Accordingly, the inventors developed a lifting mechanism that greatly simplifies removal, repositioning and manipulation of an access panel, and also serves as an added support for the access panel when in a nested position. The following description includes numerous specific details, such as example uses with an auxiliary module of a spa. These details are set forth for purposes of explanation, to provide a thorough understanding of the present invention. It will be apparent, however, to one skilled in the art that the present invention may be practiced without these specific details.

Figure 1:
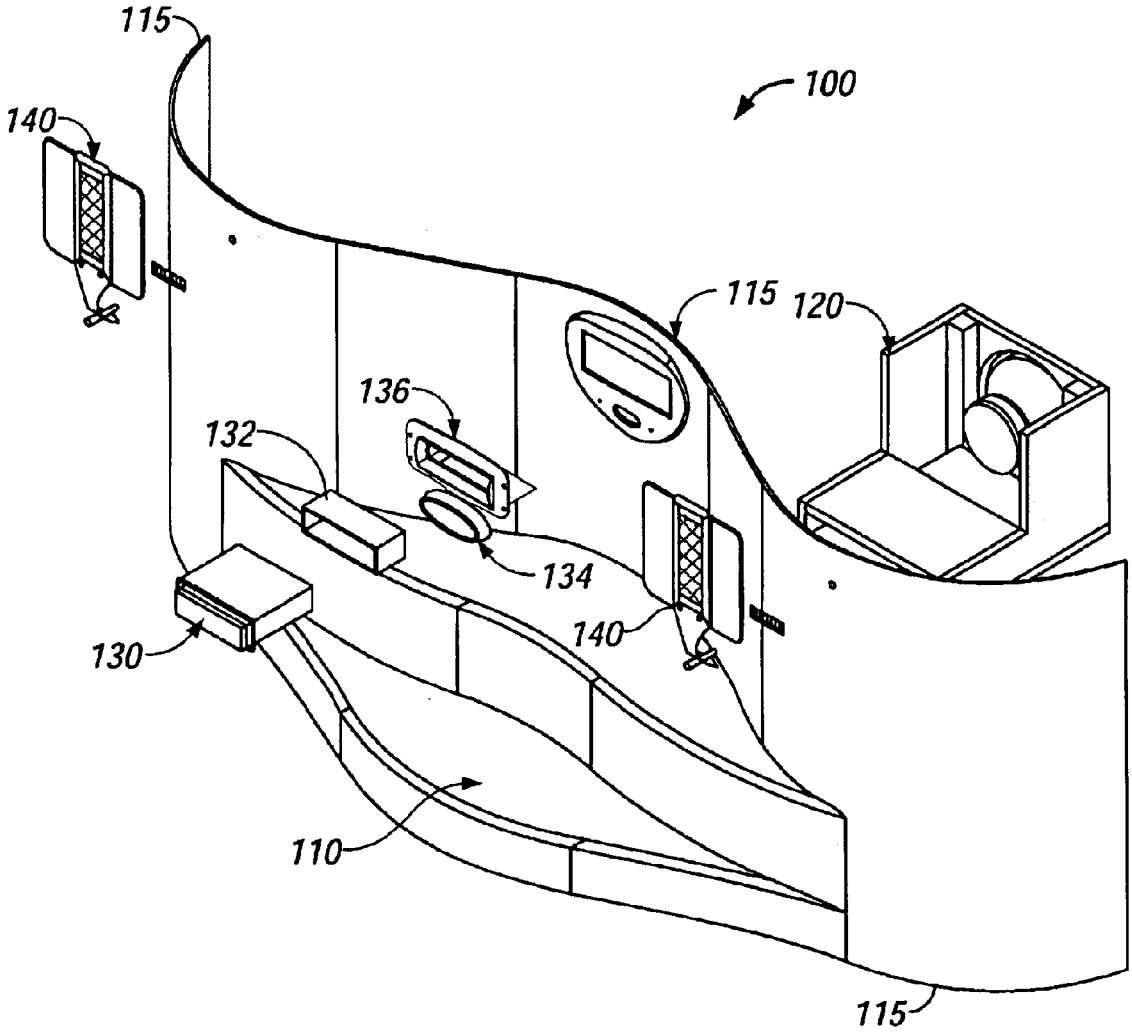
FIG. 1 is an exploded perspective view of an exemplary auxiliary module.

FIG. 1 is an exploded perspective view of an exemplary auxiliary module 100. The auxiliary module 100 serves as a separate exterior compartment for a spa that can also function as an entry point to other compartments integrated into the spa between a skirt of the spa and the spa shell. The module 100 includes a compartment 110 defining a location that receives one or more devices to be used in conjunction with the spa. For example, the device(s) can include a sub-woofer assembly 120, which can include an amplifier and sub-woofer used in a spa entertainment system.

The module 100 also includes a surface 115 that matches a shape of a skirt of the spa. For example, the module 100 may be a single thermoformed piece, molded to follow the contour of the front of the spa. In the example module shown, the surface 115 has a sinusoidal shape, which matches the spa to which the module 100 is designed to attach. Other shapes are also possible. The module 100 can be interchanged with a traditional spa-skirt section on a spa, thereby creating more usable space within the framework of the spa for various added spa features. The module 100 can be fastened to the spa using screws, battens and/or other locking devices. This modular design creates a flexible spa system, where a base model of a spa can first be sold, and then various aftermarket spa options can be sold separately and be easily integrated into the spa, despite limited usable space within the first-sold spa.

Moreover, the exterior of the module 100 may also be designed to serve some additional useful purpose. For example, the module 100 may be designed to serve as a bench, a cooler or, as shown, a set of steps used to access the spa. The exterior of the module 100 may be supported by the compartment 100, which may include reinforcing. For example, the steps shown in FIG. 1 may be supported from the inside by one or more compartments that have been secured in place with fiberglass.

The module 100 may also include additional features, such as an iWatch™ lighting system 134. The module 100 may include additional features associated with a spa entertainment system. For example, there may be a flat located in the geometry of the module 100 that corresponds with an open area in the spa frame where a receiver unit 130 is installed, and speakers 140 may be installed as well. The receiver unit 130 may be installed using a mounting ring 132 and a marine cover 136. For additional details regarding spa entertainment system features that may be integrated into the module 100, see U.S. patent application Ser. No. 10/306,704, filed Nov. 27, 2002 and entitled "SPA-BASED SPEAKER", U.S. patent application Ser. No. 10/328,782, filed Dec. 23, 2002 and entitled "SPEAKER BRACKETS", and U.S. patent application Ser. No. 10/306,173, filed Nov. 27, 2002 and entitled "WIRELESS AUDIO SYSTEM IN A SPA".

Thus, the module 100 provides an optional skirting feature for a spa that can provide additional space for after-market options, serve as a compartment door to gain access to features of the spa, and also provide an additional useful function for the spa, such as by serving as a set of exterior steps. The auxiliary module 100 can be easily integrated into the skirt of the spa, and multiple types of auxiliary modules can be provided, which together with a traditional spa skirt section result in a flexible and versatile spa skirting system.

Figure 2A:
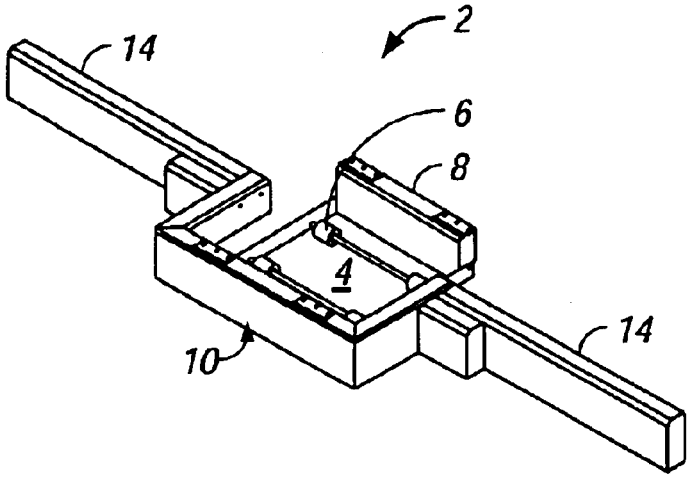
FIG. 2A is a top-side perspective view of an exemplary lift.
Figure 2B:
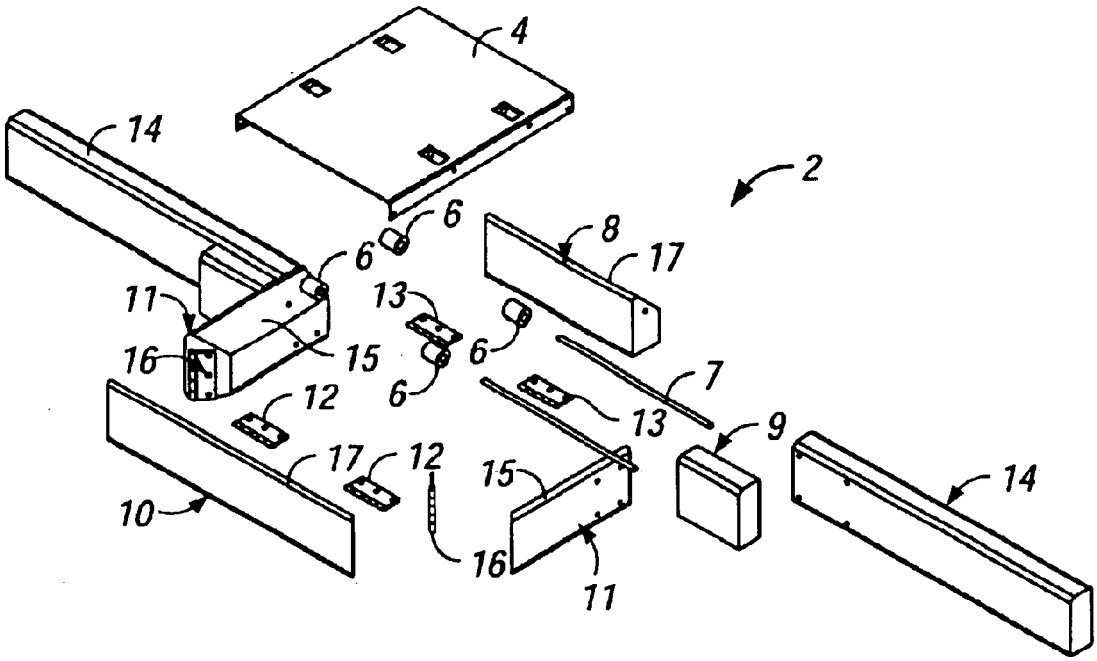
FIG. 2B is an exploded underside perspective view of the lift from FIG. 2A.

Additionally, such modules can be supported by an integrated lifting mechanism that makes installation easy and allows for ease of moment when a module is not fastened to the spa. FIG. 2A is a top-side perspective view of an exemplary lift 2. The lift includes a support frame, such as a skid plate 4, rollers 6, aft riser 8, fore riser 10, and lever-arms 14. FIG. 2B is an exploded underside perspective view of the lift 2 from FIG. 2A. This exemplary lifting mechanism may be use with the auxiliary modules shown and described herein or with other types of access panels or compartment doors. In general, the lift is attached to a base of an access panel or other structure and serves as a lifting mechanism when in an actuated position and serves as a support structure when in a nested position, The skid plate 4 can be made of a strong rigid material (e.g., aluminum or other metal) and may have a low profile to facilitate docking an attached spa structure to a spa. This low profile may also assist with storage of the lift 2. The skid plate 4 is depicted as being rectangular, although in practice it can have many shapes as long as it supports an attached structure (e.g., an auxiliary spa module). The rollers 6 are attached to the skid plate 4 to facilitate movement of the lift 2 and the attached structure. The rollers 6 can be wheels or other rolling apparatus, including a tracked rolling apparatus, and may be attached to the support frame using axels, such an axel 7, or other rotatable connecting systems.

Aft riser 8 and fore riser 10 are attached to pivot points in the skid plate 4. The risers 8, 10 should be of sufficient strength to support the load associated with the attached structure. The fore riser 10 can be attached to a base of the structure by hinges 12 to facilitate the lifting process. The aft riser 8 can be attached to the base by hinges 13 to facilitate the lifting process.

Lever-arms 14 can be attached to the fore riser 10 using hinges 16 to facilitate nesting the lift 2. When the lift 2 is not in use, lever-arms 14 can be folded about the skid plate 4 and thus reside substantially out of sight and provide support to the attached structure, such as an auxiliary spa module. The lever-arms 14 swing out from under the attached structure, clearing the body of the structure, where they then may be rotated ninety degrees. This rotation causes the attached structure to lower for removal. During this rotation, the risers 8, 10 rotate but remain parallel with respect to each other because they are linked by the support structure and the base of the attached structure, ensuring planarity throughout the entire span of travel.

In a spa-based embodiment, the risers 8, 10 and lever-arms 14 may be made from a similar material as, and be similar in appearance to, the spa support structure; the riser 10 and lever-arms 14 can function as an extension of a pedestal of the spa to support the loading of an attached auxiliary module. For example, the riser 10 and lever-arms 14 can be made of 2×4 material, such as wood or plastic. Such material may be chemically treated and/or painted to help prevent decay or attacks/consumption by living organisms.

When a module is lowered using the lift, the module can disengage from a lip that holds the top of the module in place. The module is then freely movable, The rollers may be at least partially in contact with the ground during the lifting process, providing freedom of movement for the skid plate when raising and lowering the module. In the event that the surface on which the module rests is soft or uneven, the weight of the module is supported directly by the skid plate to the same effect. When the lever-arms are fully actuated, and the module lowered, the lever-arms are no longer in contact with the ground. Moreover, the lever-arms can include tie portions 11 that include angles 15, and the riser 8, 10 can also include angles 17, on the sides facing into the structure and toward the ground. These angles or cut-away portions can ease the transition from an initial down position to an up-position of the lever-arms during the lifting process (i.e., as the module is lowered). Additionally, the lever-arms may include additional support structures, such as a block 9.

Figure 3:
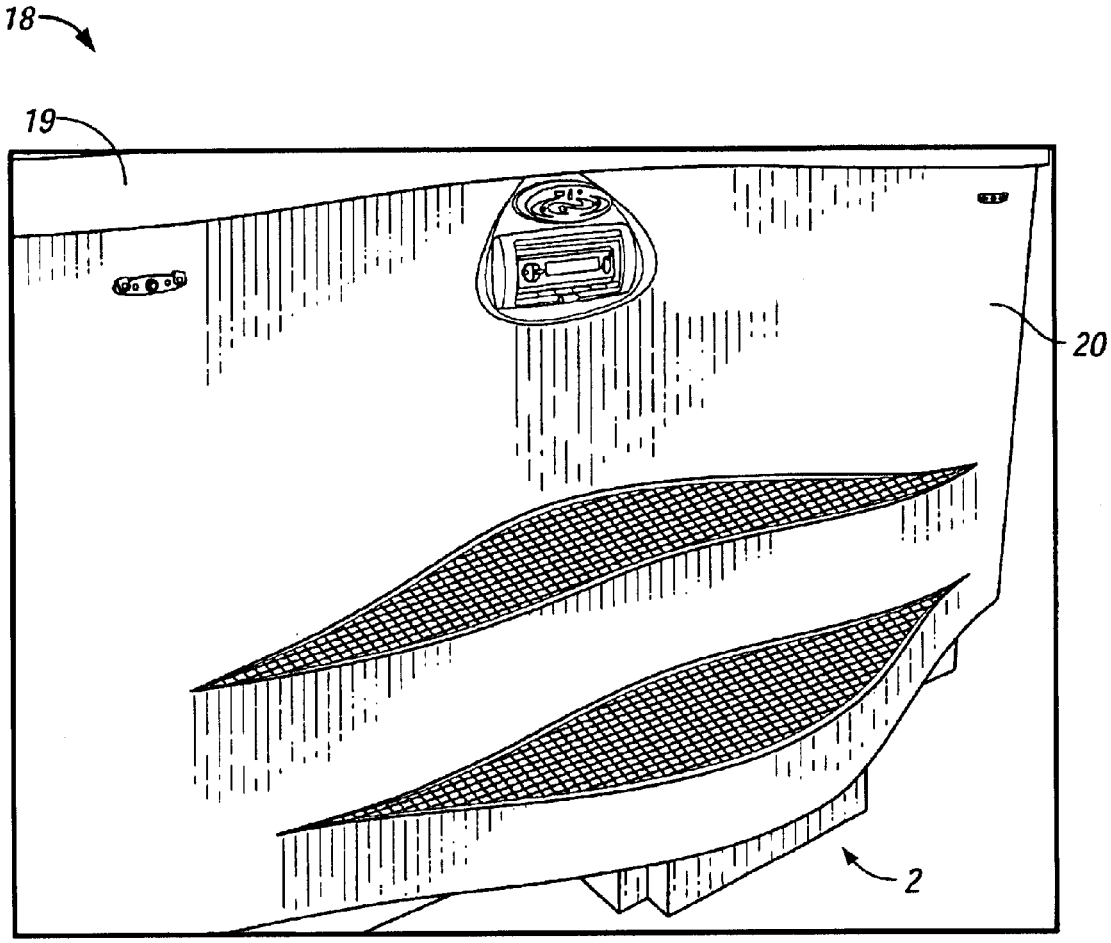
FIG. 3 is a perspective view illustrating a spa with an exemplary auxiliary module and lift in a nested position.
Figure 4:
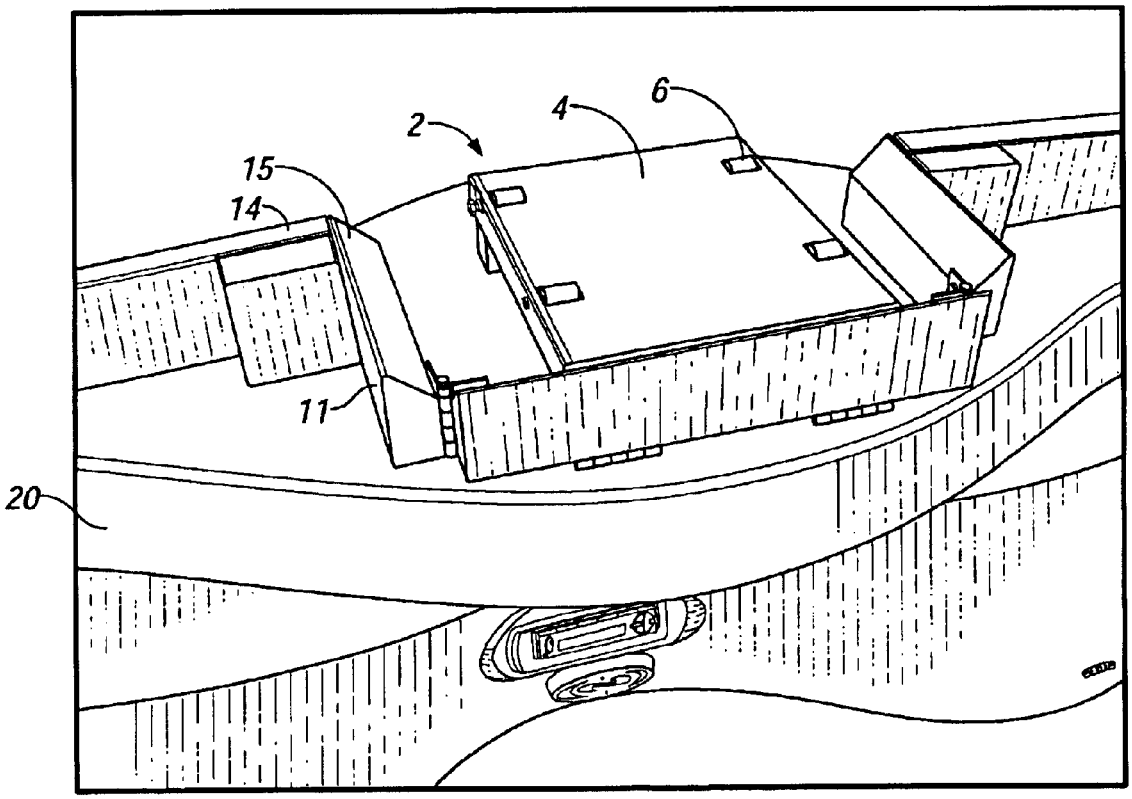
FIG. 4 is an underside perspective view illustrating the lift in its nested position.

FIG. 3 is a perspective view illustrating a spa 18 with an exemplary auxiliary module 20 and the lift 2 in a nested position. The module 20 is an example combination of the module from FIG. 1 and the lift from FIGS. 2A and 2B. The module 20 is in its nested position, which means the module 20 is raised on the lift 2 underneath a lip 19 of the spa 18. The lift 2 is also in its nested position, which means that the lift 2 resides under the module 20, supporting the module 20 on the lever-arms. FIG. 4 is an underside perspective view illustrating the lift 2 in its nested position.

Figure 5:
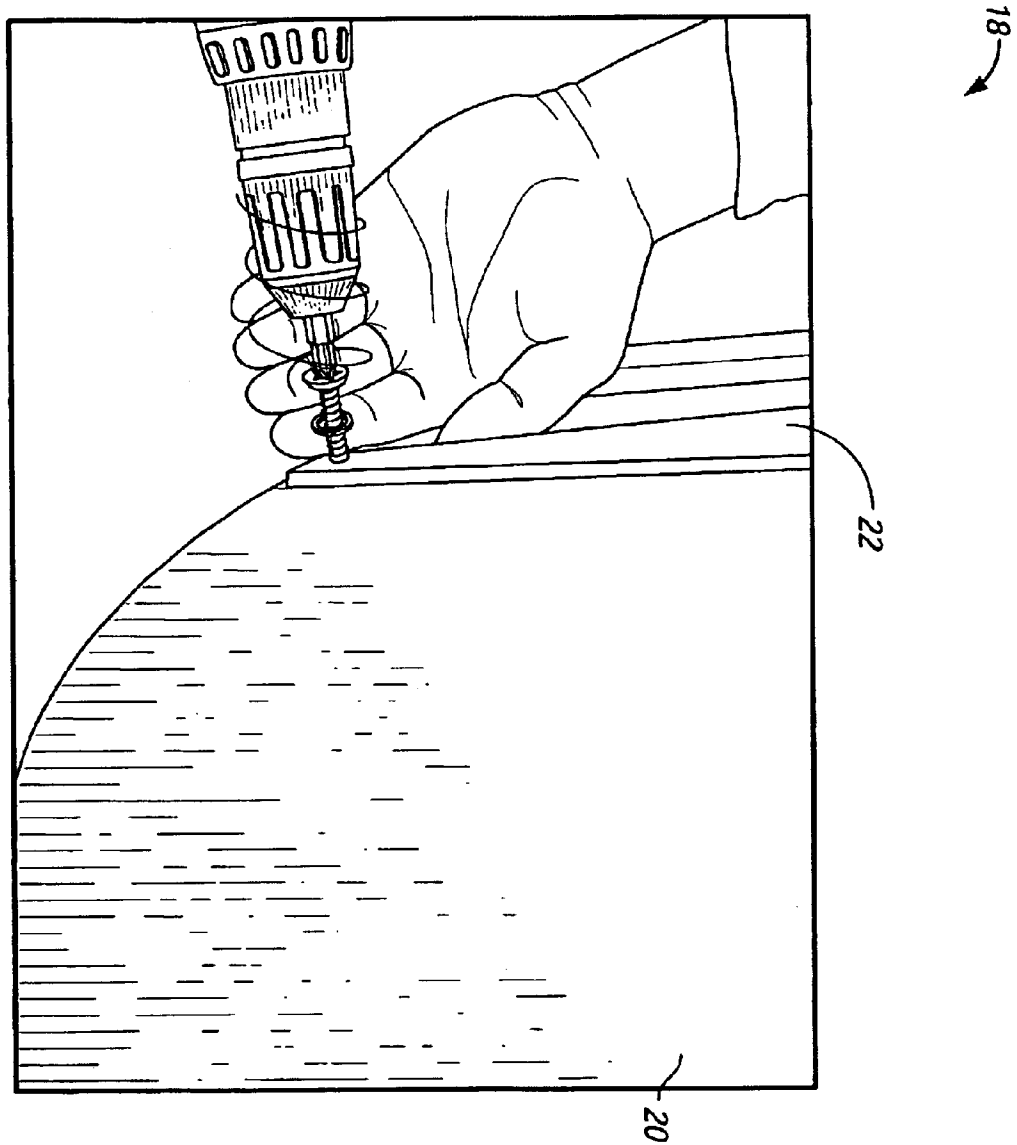
FIG. 5 illustrates unscrewing a batten used to fasten the auxiliary module to the spa.
Figure 6:
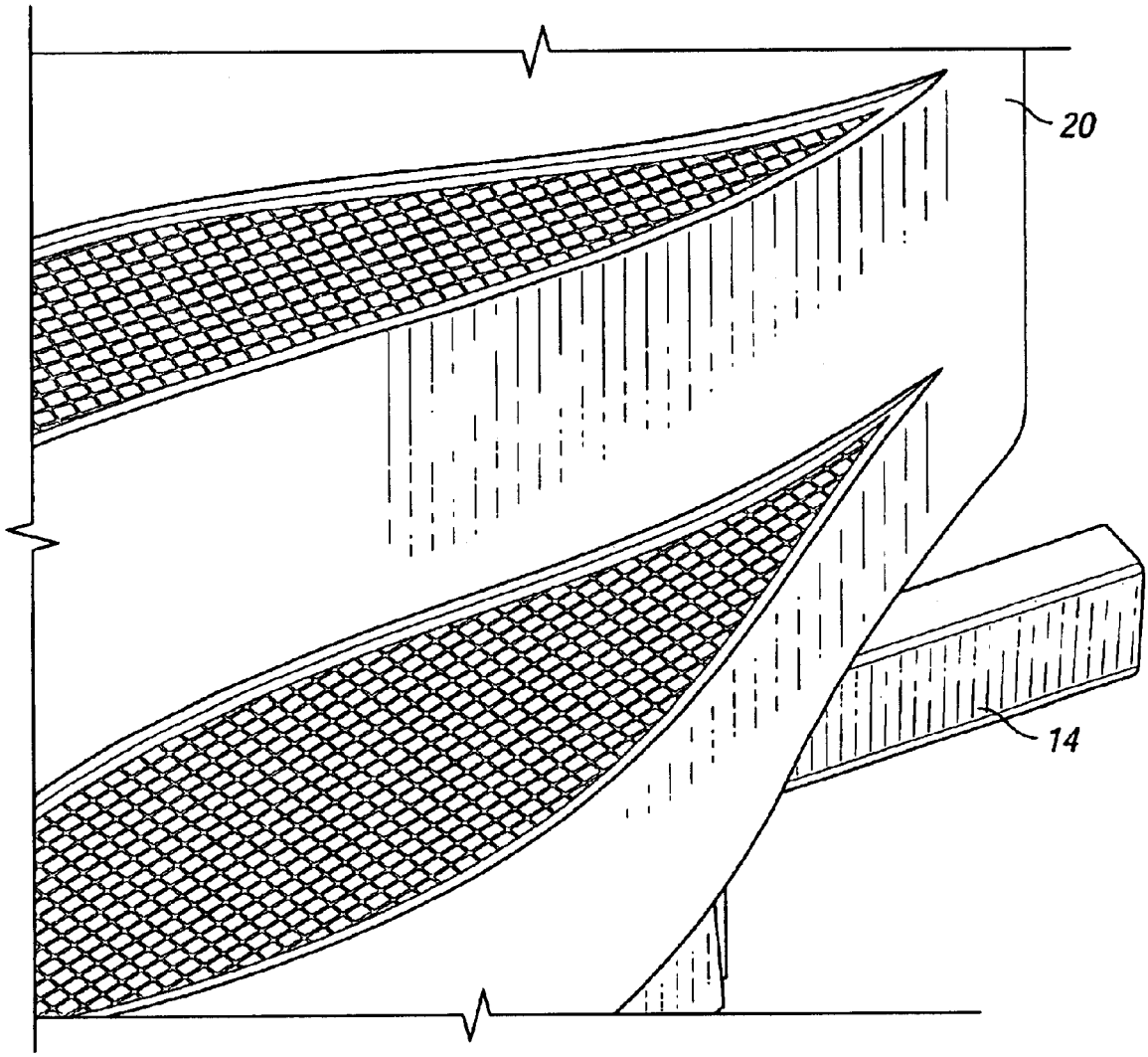
FIGS. 6 and 7 illustrate transition of the lever-arms from a nested position to a lift position.
Figure 7:
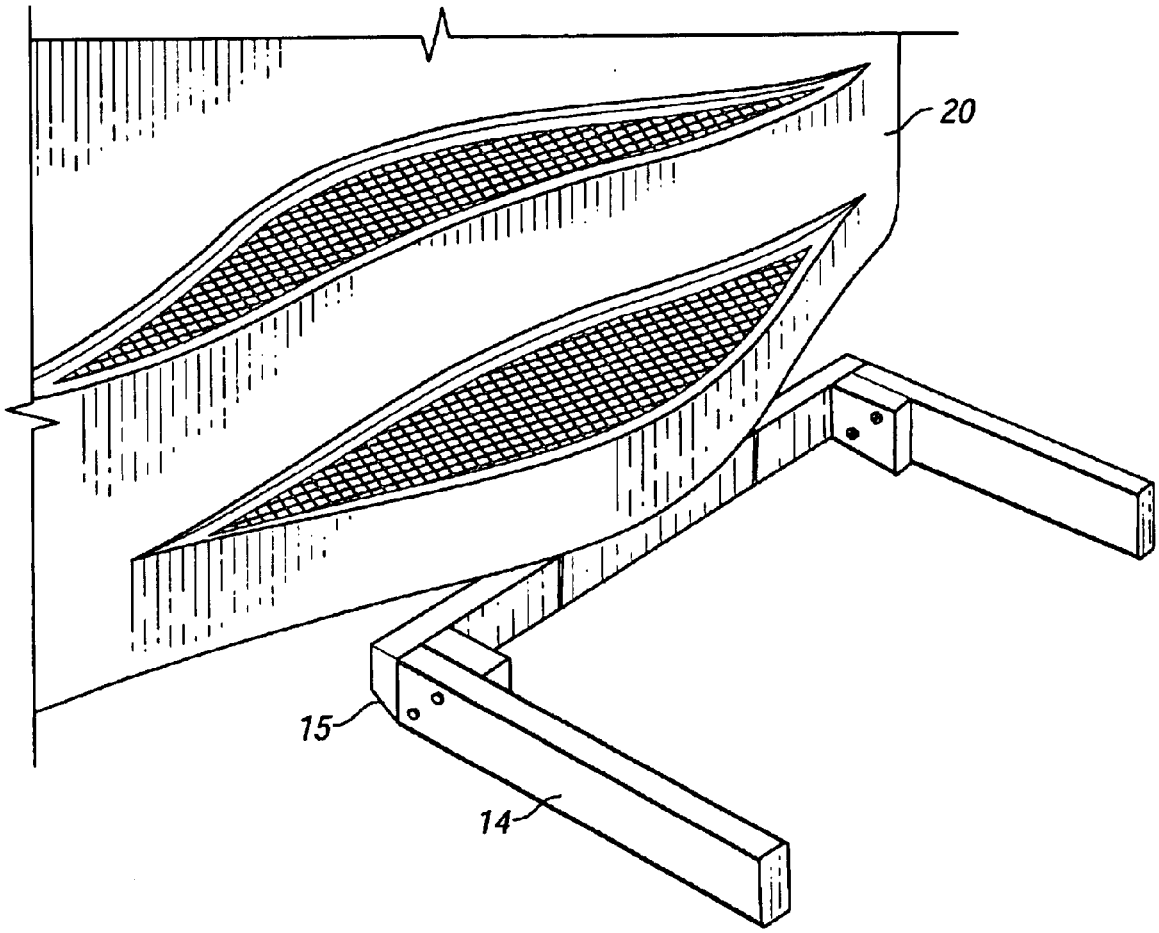

Screws and battens, or another connecting mechanism, can be used to secure auxiliary module 20 to spa 18, and can be disconnected to allow separation of the auxiliary module 20. FIG. 5 illustrates unscrewing a batten 22 used to fasten the auxiliary module 20 to the spa 18. When access to the spa storage area is desired, the auxiliary module lift 2 can be brought out of the nested position by rotating the lever-arms outward. FIGS. 6 and 7 illustrate transition of the lever-arms from a nested position to a lift position. As shown, lever-arms 14 can be rotated outward, bringing the lever-arms substantially outside the outer diameter of the spa 18.

Figure 8:
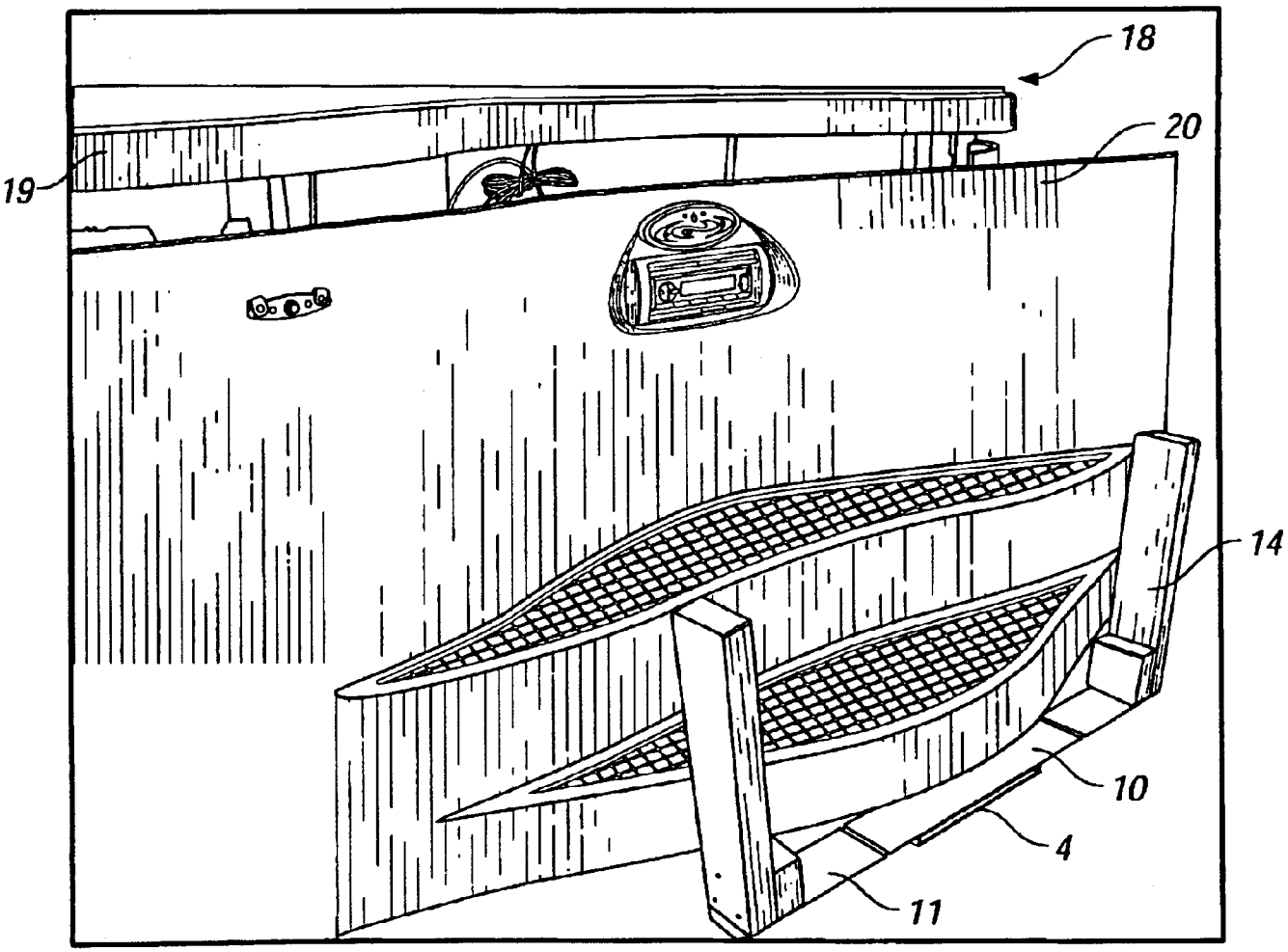
FIG. 8 illustrates actuation of the lever-arms to lower the auxiliary module.
Figure 9:
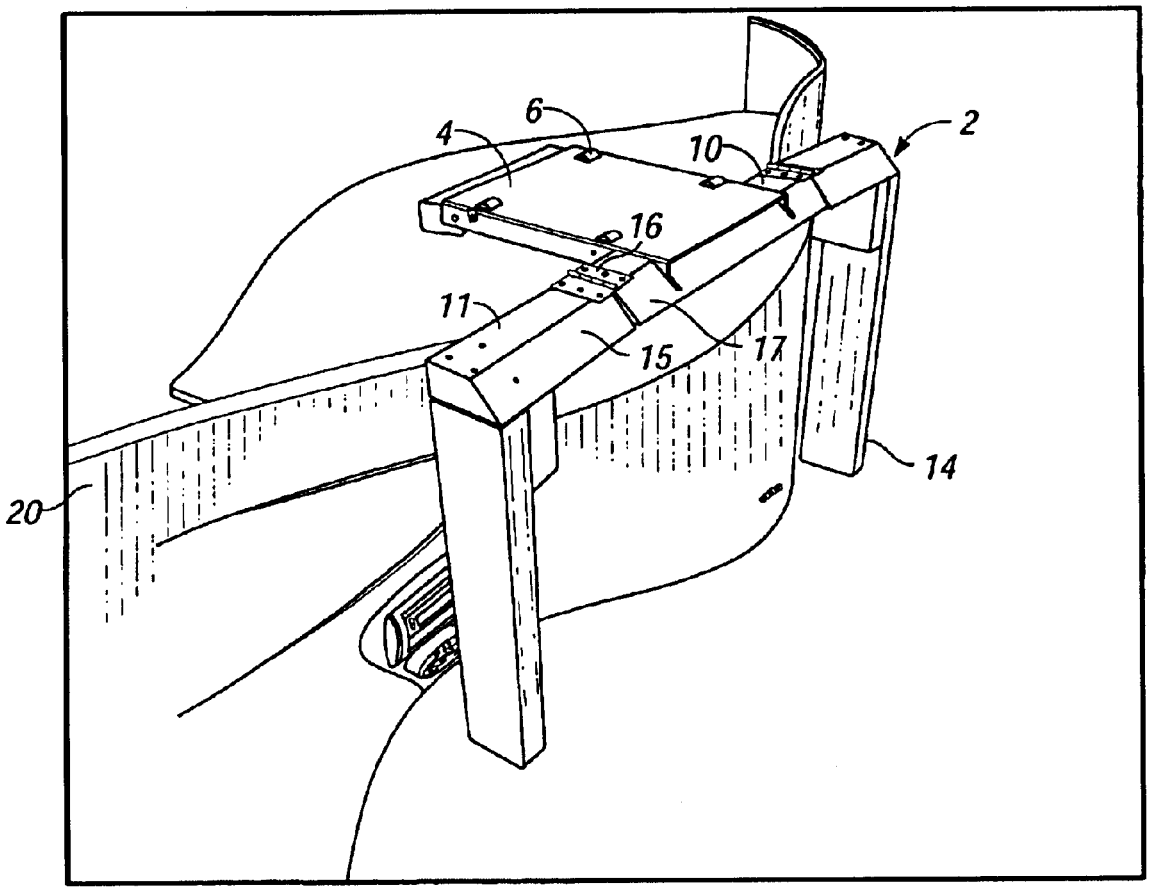
FIG. 9 is an underside perspective view illustrating the lift in an actuated position.

FIG. 8 illustrates actuation of the lever-arms 14 to lower the auxiliary module 20. The lever-arms 14 can be lifted upward, causing the rises to rotate and the module to lower. As the module 20 lowers, it clears the spa lip 19 as shown in FIG. 8. Thereafter, the rollers 6 and/or skid plate 4 are supporting the module 20 and allow the module to be moved as needed, enabling easy access to storage areas inside the spa 18 and inside the module 20. FIG. 9 is an underside perspective view illustrating the lift 2 in an actuated position. To secure the auxiliary module 20 to the spa 18, the process is performed in reverse.

A number of embodiments of the invention have been described. Nevertheless, it will be understood that various modifications may be made without departing from the spirit and scope of the invention. For example, the lift 2 can be used with other compartment and/or access structures, and the module 20 can be used without the lift 2: see U.S. patent application Ser. No. 10/403,108 filed Mar. 28, 2003 entitled "AUXILIARY SPA MODULE". One or more lever-arms 14 can be utilized, each having various shapes and dimensions to complement the shape of the spa components and to assist in the manipulation of the auxiliary module 20. Likewise, the size and shape of the skid plate 4 can be varied. Moreover, although rollers 6 have been depicted, any known method of locomotion can be utilized to assist the movement of lift 2. Additionally, lever-arm and risers can be arranged in various manners to facilitate movement of the auxiliary module 20. Accordingly, other embodiments are within the scope of the following claims.

What is claimed is:

1. A system comprising:

a spa including a spa shell;

one or more spa skirt sections forming at least a portion of a skirt of the spa; and a spa structure shaped to connect with the spa, the spa structure including a base, risers rotatably coupled with an underside of the base, a support frame rotatably coupled with the risers, rollers rotatably coupled with the support frame, and one or more lever-arms rotatably coupled with at least one of the risers, the one or more lever-arms supporting the spa structure when the support frame is in a nested position, and the one or more lever-arms providing leverage during transition from the nested position to an actuated position of the support frame, said transition causing the spa structure to lower and be movable on the rollers.

2. The system of claim 1, wherein the support frame comprises a skid plate.

3. The system of claim 2, wherein the spa structure comprises an access panel of the spa.

4. The system of claim 2, wherein the one or more lever-arms comprise two lever-arms comprising a material used in a pedestal that supports the spa.

5. The system of claim 2, wherein the skid plate comprises a rigid material.

6. The system of claim 2, wherein the access panel comprises a section of the spa skirt.

* * * * *